US006149751A

United States Patent [19]

Marschke

[11] Patent Number: 6,149,751

[45] Date of Patent: Nov. 21, 2000

[54] LOW PRESSURE SINGLE FACER

[75] Inventor: Carl R. Marschke, Phillips, Wis.

[73] Assignee: Marquip, Inc., Phillips, Wis.

[21] Appl. No.: 08/856,662

[22] Filed: May 15, 1997

Related U.S. Application Data

[63] Continuation-in-part of application No. 08/740,726, Nov. 1, 1996.

[51] Int. Cl.[7] ..... B31F 1/28

[52] U.S. Cl. ..... 156/205; 156/472

[58] Field of Search ..... 156/210, 471, 156/472, 473, 205, 583.3

[56] References Cited

U.S. PATENT DOCUMENTS

| | | | |
|---|---|---|---|
| 1,186,998 | 6/1916 | Langston | 156/472 |
| 1,519,280 | 12/1924 | Wandel | 156/470 |
| 2,979,112 | 4/1961 | Wilson | 156/473 |
| 3,004,880 | 10/1961 | Lord | 156/210 |
| 3,920,496 | 11/1975 | Wilkinson et al. | 156/210 |
| 3,960,475 | 6/1976 | DeLigt et al. | 425/505 |
| 5,498,304 | 3/1996 | Shaw et al. | 156/210 |
| 5,614,048 | 3/1997 | Barney et al. | 156/205 |
| 5,728,256 | 3/1998 | Shulz et al. | 156/472 |

*Primary Examiner*—Michael W. Ball
*Assistant Examiner*—Barbara J. Musser
*Attorney, Agent, or Firm*—Andrus, Sceales, Starke & Sawall

[57] ABSTRACT

A method and apparatus for producing a single face corrugated web from an adhesively bonded liner and medium web without the use of a pressure roll nip where the liner web is joined to the medium web. A heated bonding roll with a fluted outer surface carries the single face web around a circumferential portion sufficient to create a green bond in the glue lines before the web is removed from the roll. The bonding roll may be internally heated or a steam chamber may be positioned around a portion of a lower bonding roll, such that the steam chamber introduces a supply of steam into contact with the single face web while the single face web is in contact with the outer circumference of the bonding roll. An adjustable wrap arm places the freshly glued single face web in contact with the bonding roll and tension in the liner web is controlled to adjust the radial force applied to the glue lines.

9 Claims, 5 Drawing Sheets

10
11
12
13
14
15
16
17
18
20
21
22
23
24

LOW PRESSURE SINGLE FACER

CROSS REFERENCE TO RELATED APPLICATIONS

This is a continuation-in-part of application Ser. No. 08/740,726, filed Nov. 1, 1996.

BACKGROUND OF THE INVENTION

The present invention pertains to an apparatus for forming a single face web of corrugated paperboard and, more particularly, to a corrugating roll assembly for a single facer.

In the manufacture of corrugated paperboard, a single facer apparatus is used to corrugate the medium web, apply glue to the flute tips on one face thereof, and to bring a liner web into contact with the glued flute tips of the medium web with the application of pressure and downstream heating to provide an initial bond. A conventional single facer typically includes a pair of fluted corrugating rolls and a pressure roll, which are aligned so the axes of all three rolls are generally coplanar. The medium web is fed between the inter-engaging corrugating rolls and the adhesive is applied to the flute tips by a glue roll while the medium is still on the corrugating roll. The liner web is immediately thereafter brought into pressurized contact with the adhesive-coated flute tips in the nip between the pressure roll and the corrugating roll.

As corrugating nip roll pressures and corrugating speeds have increased, changes have been made in the construction of single facers to maintain the quality of the corrugated medium and to attempt to deal with the problems of high noise and vibration. For example, the load between corrugating rolls at the corrugating nip has required that one of the fluted corrugating rolls be made with a crowned surface to accommodate roll deflection under high nip loads. Deflection as a result of high loading is also believed to be one source of noise and vibration. In a conventional single facer construction, where the two corrugating rolls and the lower pressure roll are in general alignment (their axes lying generally coplanar), corrugating roll loads are transmitted to the pressure roll adding further to the problems associated with high loads and high speeds. This has resulted, in some cases, in manufacturing the pressure roll with a negative crown to match deflections in the corrugating roll which together form the nip for joining the two single face web components.

One of the most serious problems in the operation of high speed single facers is the stress applied to the medium web and liner web as the liner is introduced into contact with the medium web under pressure. Because of this pressure induced stress on the corrugated web, the possible thickness of the corrugated paperboard currently is limited such that the individual web components are thick enough to withstand the stress and resist tearing. Tests done with lighter weight web components have shown that the current techniques literally shred the medium web along the lines of the row teeth of the corrugating rolls due to the high pressure between the corrugating roll and the pressure roll containing the liner.

It has long been presumed that high pressure contact between the pressure roll and the single face web on the corrugating roll was necessary to provide an initial bond which would be fully gelatinized and cured by the residual heat in the two component webs produced by upstream web preheaters and heated corrugating rolls. More recent studies have indicated, however, that a high pressure nipping of the newly joined corrugated medium and single face web actually squeezes moisture from the fresh glue lines at the flute tips and, without moisture, the starch based adhesive cannot gelatinize and no bond will occur at the flute tips. Only the portions of the glue line on the flanks adjacent the flute tips gelatinize and provide the initial tack needed to hold the web together. Even so, the subsequent creation of the necessary green bond, which results from dehydration of the gelatinized glue, requires that adequate heat be supplied over a sufficient length of time. In most prior art single facers, the glued single face web is fed directly from the high pressure nip into the downstream bridge storage and initial dehydration and completion of the green bond is accomplished primarily by the residual heat in the web. However, the initial bond created at the pressure roll nip is often inadequate to assure the integrity of the glue lines as the single face web is flexed and gathered in the bridge storage area downstream from the single facer. Lack of formation of adequate green bond strength may, however, result in a single face web which will not hold together during subsequent processing through the bridge storage area, the double backer, and downstream dry end processing, the result of which may be delamination and the formation of loose back.

One recently developed apparatus and process for addressing the prior art problems is disclosed in U.S. Pat. No. 5,614,048. In that apparatus, the liner web is joined to the glued corrugated medium web on the surface of the lower corrugating roll with a pressure roll operating at a very low nip pressure. After joinder, the single face web is wrapped on the surface of the lower corrugating roll over a circumferential portion not exceeding an arc of about 80°. Thereafter, the single face web is taken off the lower corrugating roll and back wrapped (or wound with the liner face of the web) around another heated roll having a smooth outer surface through a larger arc not exceeding about 200°. The use of the second heated roll is necessary to provide adequate heated surface contact which is not available on the heated lower corrugating roll before the freshly glued single face web is removed therefrom. The back wrapping of the web on the heated smooth surface roll downstream from the corrugating roll necessarily takes place before adequate green bond strength has been attained in the glue lines. It is believed that the back wrapping of the single face web at this point cannot apply sufficient pressure to the glued flute tips to optimize the formation of the green bonds.

SUMMARY OF THE INVENTION

In accordance with the present invention, a single facer for corrugated paperboard includes a bonding roll which has a fluted outer surface upon which the glued corrugated medium and single face webs are joined without a pressure roll, heated and wrapped around a portion of the drum to maintain the freshly glued single face web in contact with the roll surface for a time sufficient to create a green bond in the glue lines joining the liner to the fluted medium. The bonding roll, which may engage the lower of a pair of medium web corrugating rolls, may be heated internally or externally. The bonding roll may have vacuum applied to the web carrying surface from the inside of the roll to assist in removing moisture if steam is used to heat the web from the outside. In order to provide adequate resident time of the glued web on the bonding roll, such that the adhesive may completely gelatinize and be transformed well into the green bond region, large bonding roll diameters are required so that the portion upon which the single face web is wrapped will provide a residence time of at least about 500 milliseconds. For example, with a single face web moving through the single facer at 1,000 feet per minute (5 m/sec), a 4 foot diameter bonding roll will require the web to be wrapped over approximately 240° of the roll circumference.

The single face web may alternately be heated with a steam chamber positioned to be in communication with the web along a portion of the outer circumference of the bonding roll, such that the steam chamber introduces a supply of steam into contact with the single face web while the web is in contact with the bonding roll.

In another feature of the invention, the individual flutes contained on the outer circumference of the bonding roll are constructed to have a greater depth than the depth of the flutes contained in the corrugated medium web, thereby creating a vacuum cross channel defined by the difference in the flute depths. A source of negative pressure is supplied to the interior of the bonding roll and is in communication with the vacuum cross channels, such that the source of negative pressure within the bonding roll causes steam from the steam chamber to pass through the single face corrugated web and therefore cure the adhesive bonds contained therein.

In another embodiment of the invention, the bonding roll carrying the corrugated medium and the liner web is contacted by an arcuate heating module which has a flexible heat transfer surface adapted to conform to a portion of the cylindrical outer surface of the liner web which has been brought into contact with the corrugated medium on the bonding roll. Means are provided for holding the heat transfer surface in intimate low pressure contact with the outer surface of the liner web, and a source of heat is provided to heat the module.

In one variation of this embodiment, the heating module includes a chamber which contains the heat source, an enclosing membrane which provides a flexible chamber wall and comprises the heat transfer surface, and the heat exchange fluid within the chamber to transfer heat from the heat source to the heat transfer surface. The heat source comprises a series of interconnected heating tubes which extend through the chamber, and means for circulating a heating fluid through the tubes. The heating fluid preferably comprises steam and the heat exchange fluid preferably comprises a low density liquid or a gas. The holding means is operative to move the heat transfer surface out of contact with the liner web.

In another variation of this embodiment, the heating module comprises a series of parallel flexible bands which extend along the portion of the outer surface of the liner web in the direction of web travel and provide the flexible heat transfer surface. A series of interconnected heating tubes extend in parallel spaced relation across the outer surfaces of the bands, transverse thereto and to the direction of web travel. The heating tubes are attached directly to the outer surfaces of the bands. The holding means includes actuators which are connected to the opposite ends of each of the bands, and means are provided for selectively operating the actuators to vary the width of the heat transfer surface in contact with the liner web surface.

The heating tubes are provided with radially inner surfaces which are formed to define cylindrical surface portions each having a radius equal to the radius defined by the outer surfaces of the bands when the bands are positioned in contact with the outer surface of the liner web on the bonding roll. The heating tubes are preferably interconnected to provide a serpentine path for a heating fluid, and the heating fluid preferably comprises steam. The heating module is positioned beneath the bonding roll with the downstream-most and upstream-most heating tubes defining the upper ends of the module. Means are provided for supplying steam to one end of each set downstream-most and upstream-most heating tubes, and means are also provided for withdrawing steam condensate from the lower most heating tube in the module.

In accordance with a presently preferred embodiment of the invention, means are provided for adjustably wrapping the freshly glued single face web around a circumferential portion of the bonding roll immediately downstream of the line where the two component webs are joined. This embodiment is particularly well adapted for use with a corrugating nip formed between the fluted bonding roll and a substantially smaller diameter fluted corrugating roll, in a manner generally described in my copending U.S. application identified below. The use of the small diameter corrugating roll allows the apparatus for applying glue to the flute tips and the device for joining the single face liner to the corrugated medium to be placed close to the corrugating nip and to one another along a circumferential portion of the bonding roll not exceeding an arc of about 90°. This, in turn, permits a very large portion of the bonding roll circumference, up to about 270°, to be used for maintaining the single face web in contact therewith to assure adequate formation of green bonds.

The adjustable wrapping means preferably comprises a wrap arm which is mounted for rotation on the axis of the bonding roll, an idler roll which is carried by the wrap arm and positioned adjacent the glued single face web on the bonding roll and with the axis of the idler roll parallel to the bonding roll axis, and means for rotating the wrap arm on the axis of the bonding roll to wrap a selected length of the glued single face web on the bonding roll surface. Drive means are provided downstream of the wrap arm idler roll to carry the single face web to a downstream processing station. The means for joining a liner to the corrugated medium web comprises a rotatable liner roll which carries the liner web thereon and forms with the bonding roll a nip for joining the two webs. Preferably, the liner roll includes a braking device for retarding rotation of said roll and increasing the tension in the liner web wrapped on the bonding roll.

In accordance with the related method, substantially complete adhesive green bonds are formed in a single face web in accordance with the steps of: providing a heated fluted rotary bonding roll; feeding a medium web into a corrugating nip which is formed by rotatably engaging the bonding roll with a small diameter fluted corrugating roll; applying an adhesive to the exposed flute tips of the corrugated medium web as it exits the corrugating nip; joining the liner web to the glued flute tips of the corrugated medium on the bonding roll; and wrapping the single face web around the bonding roll downstream from the line of joining and along a circumferential portion of the bonding roll which is adjustably selected to provide formation of the green bonds.

DETAILED DESCRIPTION OF THE PREFERRED EMBODIMENT

Figure 1:
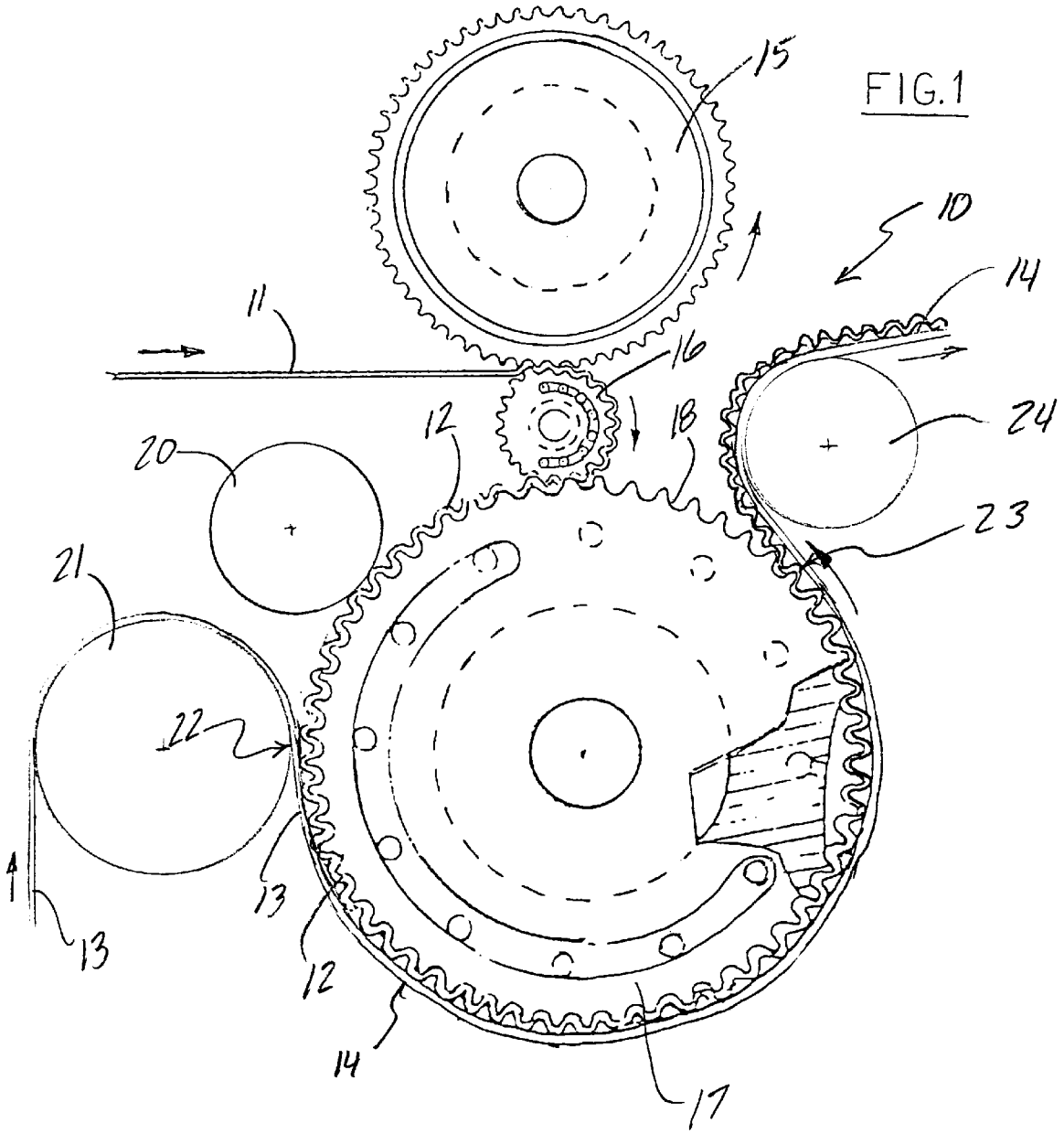
FIG. 1 is a schematic side elevation view of the single facer incorporating the construction of the presently preferred embodiment of the present invention.

Referring initially to FIG. 1, a single facer 10 embodiment of the present invention operates to form a corrugated medium web 12 from an incoming medium web 11 and to join it to a liner web 13 to form a composite single face web 14, which function is generally characteristic of prior art single facers. In the embodiment shown, the single facer 10 utilizes the invention of my U.S. patent application Ser. No. 08/621,998, entitled "Single Facer with Small Intermediate Corrugating Roll", filed on Mar. 26, 1996, now U.S. Pat. No. 5,628,865. However, it is understood that the subject invention may be applied as well to more conventional prior art single facers.

The incoming medium web 11 is directed into the corrugating nip defined by the interengaging flutes of an upper corrugating roll 15 and an intermediate corrugating roll 16. The medium web 15 is deformed in the corrugating nip to provide the characteristic corrugated medium web 12 which is wrapped around the intermediate corrugating roll 16 and into the nip formed between intermediate corrugating roll 16 and a fluted bonding roll 17 comprising a key element in the single facer of the present invention. The bonding roll 17 includes a fluted outer surface 18 onto which the corrugated medium web 12 is transferred.

In a manner known in the art, the flute tips of the corrugated medium web 12 being carried on the fluted surface 18 of the bonding roll 17 are contacted by a glue roll 20 having a layer of a typical aqueous starch-based adhesive thereon which is transferred to the flute tips to create continuous glue lines across the flute tips in the machine direction. Just downstream from the glue roll 20 the liner web 13 is brought tangentially into contact with the glued flute tips of the corrugated medium web 12. Upstream of the initial contact point, the liner web 13 is preferably wrapped around the circumference of a preheater roll 21 which heats the web to at least a temperature sufficiently higher than the gelatinization temperature of the adhesive (which is about 150° F. (66° C.)), preferably at least about 180–212 degrees F. (82–100° C.). Either or both of the upper and intermediate corrugated rolls 15 and 16 may also be heated to cause a preheating of the corrugated medium web 12 as well. The preheater roll 21 is spaced from the fluted outer surface 18 of the bonding roll 17 by a distance sufficient to preclude any significant nip pressure on the joined webs 12 and 13. As will be appreciated by those in the art, any method of conventional preheating, whether by a roll, hot air, or other radiant energy, or other known source, may be employed in preheating the web, or it may be found that preheating is not required in particular applications.

It will be further appreciated by those in the art that the present invention is not limited to conventional starch-based adhesive. Any adhesive whose performance is affected by the phenomena of drying or heating could be employed in variations of the present invention. For example, PVA adhesives could be employed, as could thermosetting resins such as phenolic resins.

The absence of a pressure roll or any means for imposing a joining force on the glue lines between the corrugated medium web and the liner web distinguishes the single facer of the present invention from prior art devices. Recent studies have suggested that pressure rolls in prior art single facers tend to squeeze the adhesive glue lines with sufficient pressure to actually squeeze the water from the starch adhesive. Without water, this portion of the glue line extending right along the flute tip cannot gel, much less form a green bond and cure. This portion is, therefore, completely lost to the bonding mechanism and only the portions of the glue lines on the flanks of the flutes as they curve away from the tips are available to form the actual glue bond. Furthermore, reliance on the residual heat in the two component webs to gelatinize the starch adhesive and to create at least initial dehydration to provide a green bond, is insufficient. As a result, the initially joined single face web leaving the high pressure nip of a conventional single facer has inadequate strength to assure sufficient single face integrity for subsequent downstream handling.

In accordance with the primary aspect of the present invention, adequate green bond strength of the adhesive joints is created on the bonding roll 17 by applying heat to the freshly joined single face web 14 at a temperature and for a time sufficient to establish a green bond. Green bond strength relies on the removal of water from the adhesive, either by migration into the paper or from evaporative dehydration of the aqueous starch adhesive. The latter is the more significant phenomenon, and is also amenable to manipulation, and, therefore, it is necessary to raise the web temperature significantly above the initial gelatinization temperature to achieve an adequate green bond strength. In addition, the web must be maintained at the higher temperature level for an adequate length of time. Furthermore, and specifically in accordance with the present invention, the glued single face web 14 is maintained at a green bond formation temperature and for a necessary period of time on the bonding roll 17 itself. In this manner, the integrity of the single face web is retained and assured by retaining the corrugated medium web on the mating fluted surface 18 of the bonding roll with the outer liner web 13 in intimate (but low pressure) contact therewith. It will be appreciated that, in prior art single facers, directing the single face web away from the transfer roll or pressure roll immediately after nipping contact will preclude the formation of an adequate green bond to maintain web integrity. Although the latent heat in the web may be sufficient to eventually form a green bond, such bond may not occur until the web has been transferred over reversing takeup rolls and the like and into the bridge storage, causing undesirable flexing and disruption of the inadequate bond.

Referring again to FIG. 1, the bonding roll 17 is preferably heated internally with a conventional live steam system of a type well known in the art. In such systems, live steam is supplied to the interior of the roll by an axially disposed steam supply tube of a type, for example, discussed with regard to the FIG. 2 embodiment. The bonding roll 17 is heated to provide a temperature at the fluted outer surface 18 sufficient to raise the temperature of the web and adhesive to 200° F. (93° C.) or higher, and preferably to about 215° F. (102° C.), to facilitate dehydration and formation of the green bond. In order to achieve sufficient heat transfer to raise the adhesive temperature to that point, the bonding roll surface temperature should be at about 360–380° F. (182–193° C.) or more. Although green bond formation will begin immediately at the indicated temperature, substantial dehydration of the glue line and adjoining web surfaces must occur before adequate green bond strength is realized. It has been estimated that 80% of the moisture must be removed for full green bond strength. Thus, in accordance with the other aspect of the invention, the single face web 14 is retained on the surface of the bonding roll 17 for a period of time adequate to assure good green bond formation. Although commentators in the art have suggested that green bond formation begins as quickly as 20 milliseconds after component web joinder in the pressure roll nip, it is believed that retaining residence of the single face web on the fluted bonding roll for a much longer period of time, up to about 500 milliseconds, will provide the necessary full green bond strength. In the FIG. 1 embodiment, it will be seen that the single face web is wrapped substantially more than 180° around the circumference of the bonding roll before the tangential takeoff point 23 where the single face web is back wrapped around a takeoff roll 24. The position of the takeoff roll 24 may be adjusted to vary the amount of wrap on the bonding roll between the takeoff point 23 and the upstream initial tangent contact point 22 where the liner web 13 is initially joined with the corrugated medium web 12. It should be noted that any known system of takeoff rolls, whether a single or multiple roll design, can be employed to perform the function of takeoff roll 24, as known in the art.

As indicated above, in order to provide a 500 millisecond residence time of the single face web on the bonding roll, consideration must be given to the speed of the web through the single facer, bonding roll diameter, and the amount of circumferential wrap available. With respect to the latter consideration, it is obvious that space must be made available for the intermediate corrugating roll 16, the glue roll 20 and the preheater roll 21 or other means of bringing the liner web 13 onto the bonding roll. By making the diameter of the bonding roll substantially larger, more space is made available for the other components and, simultaneously, the circumference is enlarged to accommodate a longer single face web wrap thereon. With a web speed of 1,000 feet per minute, a 4 foot diameter bonding roll 17 will require about 240° of single face wrap to provide a web residence time on the roll of 500 milliseconds. In the embodiment shown, the large diameter bonding roll will easily accommodate this arrangement.

Figure 2:
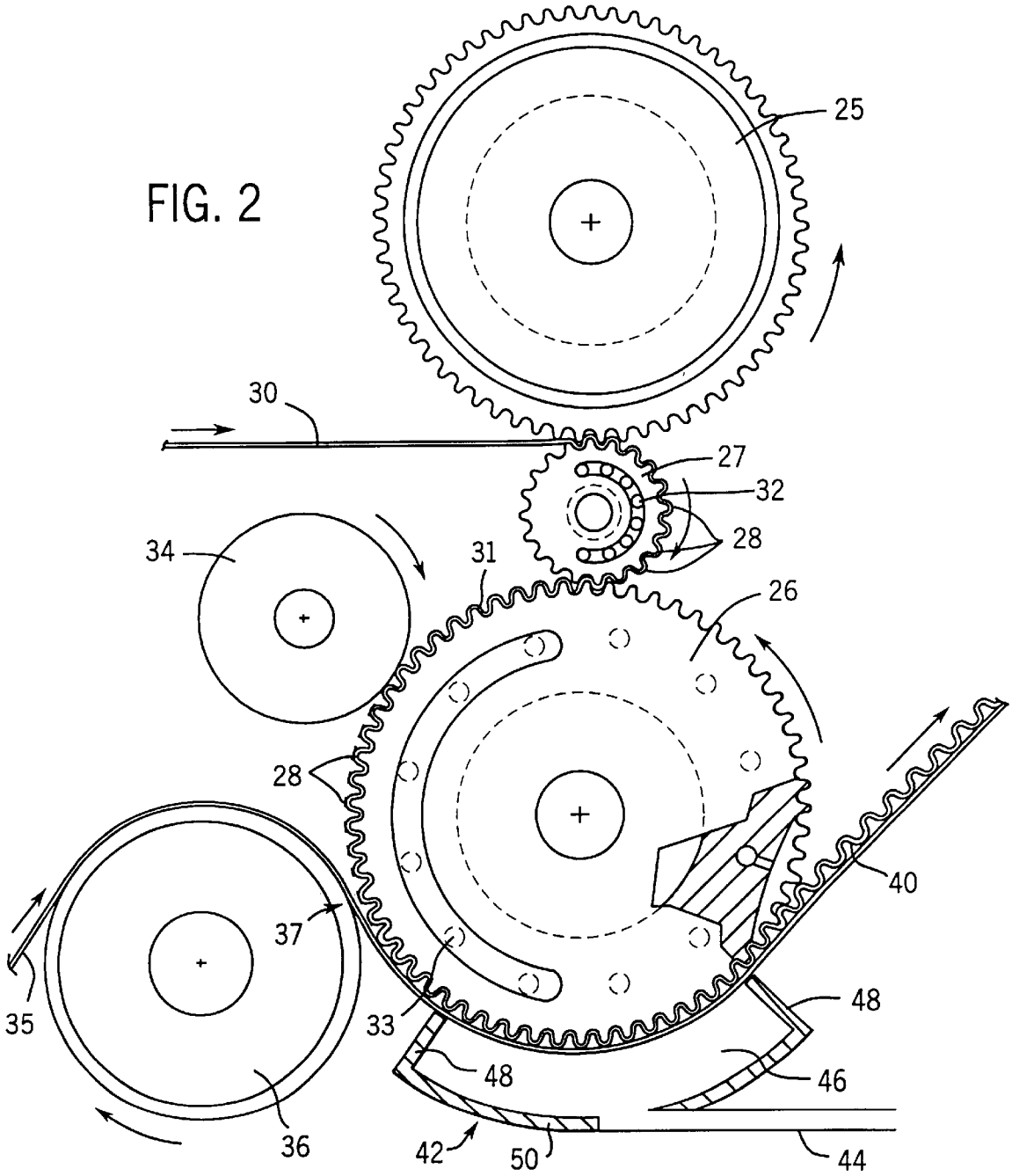
FIG. 2 is a schematic side elevation view of a single facer incorporating another embodiment of the invention.

In the single facer apparatus shown in FIG. 2, a conventional upper main corrugating roll 25 and a lower bonding roll 26 are mounted to capture therebetween and operate in rotating interengagement with a small intermediate corrugating roll 27. Each of the rolls 25, 26 and 27 is provided with a conventional fluted peripheral surface, as described with respect to the FIG. 1 embodiment, but the flutes of bonding roll 26 are of a greater depth, as will be described in detail below.

After the flutes 28 have been formed in the medium web 30 by the corrugating nip between corrugating rolls 25 and 27, the fluted medium web 31 is held in contact with the outer circumference of the intermediate corrugating roll 27 by a conventional vacuum system by which vacuum is applied via suitable networks of axial and radial vacuum passages 32.

After being carried around the intermediate corrugating roll 27, the now corrugated medium web 31 is transferred to the bonding roll 26 at the nip therebetween. As with the intermediate corrugating roll 27, the bonding roll 26 has a vacuum system in which vacuum is applied via suitable networks of axial and radial vacuum passages 33 to the corrugated medium web 31. The supply of vacuum to the corrugated medium web 31 will be discussed in greater detail below. As the corrugated medium 31 travels along the outer circumference of the bonding roll 26, the glue roll 34 of a conventional glue applicator makes rotating contact with the flutes tips of the corrugated medium 31 while it is in contact with the bonding roll.

A liner web 35 is carried around a portion of a preheater roll 36 where it is brought into contact with the glued flute tips of the corrugated medium 31 at a tangent contact or liner infeed 37. In accordance with the invention, the point of connection 37 between the liner 35 and the corrugated medium 31 does not include any pressure between the corrugated medium 31 and the liner 35. Preferably, the pre-heater roll 36 is spaced from the outer circumference of the bonding roll 26 by a distance at least as great as the combined thickness of the liner 35 and the corrugated medium 31. As in the prior embodiment, there is no stress applied to either the liner 35 or the corrugated medium 31, such that the chance of tearing either of the two webs is greatly reduced. Equally significant, the glue line at the flute tips is not squeezed to displace the moisture from it.

After the liner 35 is introduced into contact with the glued flute tips of the corrugated web 31, the composite single face web 40 continues to travel along the outer circumference of the bonding roll 26. Positioned to be in communication with the single face web 40 is a steam chamber 42. The steam chamber 42 is generally connected to a supply of steam (not shown) through a steam supply tube 44. Steam is introduced through the supply tube 44 into the open interior 46 of the steam chamber 42 which is defined by a pair of end walls 48 and an arcuate outer wall 50. Although the steam chamber 42 is described as shown in FIG. 2, any equivalent structure is contemplated as being within the scope of the invention.

Figure 3:
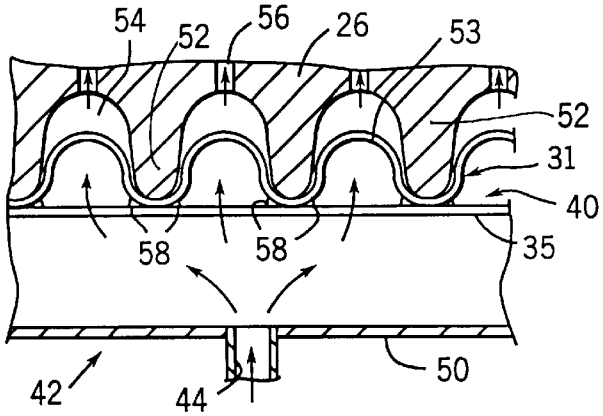
FIG. 3 is a schematic representation of the flute depth of the bonding roll and the medium web also showing the supply of steam through the steam chamber.

Turning now to FIG. 3, the interaction between the steam contained in the open interior 46 of the steam chamber 42 and the single face web 40 is more clearly shown. As can be seen in this figure, the depth of the individual flutes 52 contained on the bonding roll 26 is greater than the depth of the flutes 53 formed in the corrugated medium 31. Because the bonding roll 26 does not participate in forming the flutes in the medium 31, the flutes 52 do not have to conform to the flute profile. The difference in the depth of the flutes 53 and the flutes contained in the corrugated medium 31 creates a vacuum cross channel 54 therebetween. Each of the vacuum cross channels 54 runs the entire axial length of the bonding roll 26 and is in communication with the vacuum passage 33 contained within the interior of the bonding roll 26 through a vacuum passageway 56. As can be understood by the arrows in FIG. 3, the vacuum passageways 56 provide both a pressure gradient and an outlet for the steam introduced in the open interior 46 through the supply tube 44. Thus, the steam penetrates and passes through the liner 34 and the corrugated medium 30, heating the glue lines 58, gelatinizing the starch adhesive. The addition of further heat drives off additional water, forming the green bond between the corrugated medium 31 and the liner 35.

Referring again to FIG. 2, it is desired that the preheater roll 36 be spaced from the bonding roll 26 by distance at least as great as the combined width of the corrugated medium 31 and the liner 35. In the embodiment shown, a potential problem can arise when a splice arrives either on the medium web 30 or on the liner 35. In order to run continuously, the single facer automatically splices a new paper roll onto the running web as the expiring roll runs out. The spliced material laps over the old and new portions producing a short length of web having an additional thickness of paper. In the embodiment shown in FIG. 2, that effect will be felt since the steam in steam chamber 42 would likely not penetrate the increased thickness of web, leading to poor bonding in a portion of the web. This problem can be avoided altogether by spacing the pre-heater roll 36 slightly less than three paper thicknesses from the bonding roll 26. In this configuration, when a spliced portion arrives (either on the corrugated medium web 31 or the liner 35), the added thickness will result in the pre-heater roll 36 exerting pressure on, the combined single face web 40, producing a pressure-cure bond for only the duration of the splice. For this period, the invention functions in a manner similar to a conventional single facer, but reverts automatically and without any adjustment to the function and advantages of the invention immediately after the splice is passed through the device.

The main corrugating roll 25, the intermediate corrugating roll 27, and the bonding roll 26 may be heated with steam, as is known in the art. Alternatively, in the invention shown, the provision of a separate heating system for the bonding roll 26 may be omitted due to the steam being applied to the bonding roll by the steam chamber 42. In an embodiment without a separate source of steam being applied to the bonding roll 26, the roll should heat to a satisfactory temperature of 350–380° F. (177–193° C.) or greater within minutes of operation due to the steam in the steam chamber 42. Also, the pressure gradient applied to the web by vacuum means in this embodiment could also be applied by providing a pressure source outside the roll; in either event, the pressure above the web is greater than the pressure within the bonding roll.

It is contemplated that the heating module 60 may also be heated by hot air instead of steam, utilizing the same basic arrangement disclosed. In addition, the bonding roll 62 may be provided with an internal vacuum system, similar to that previously described.

Figure 4:
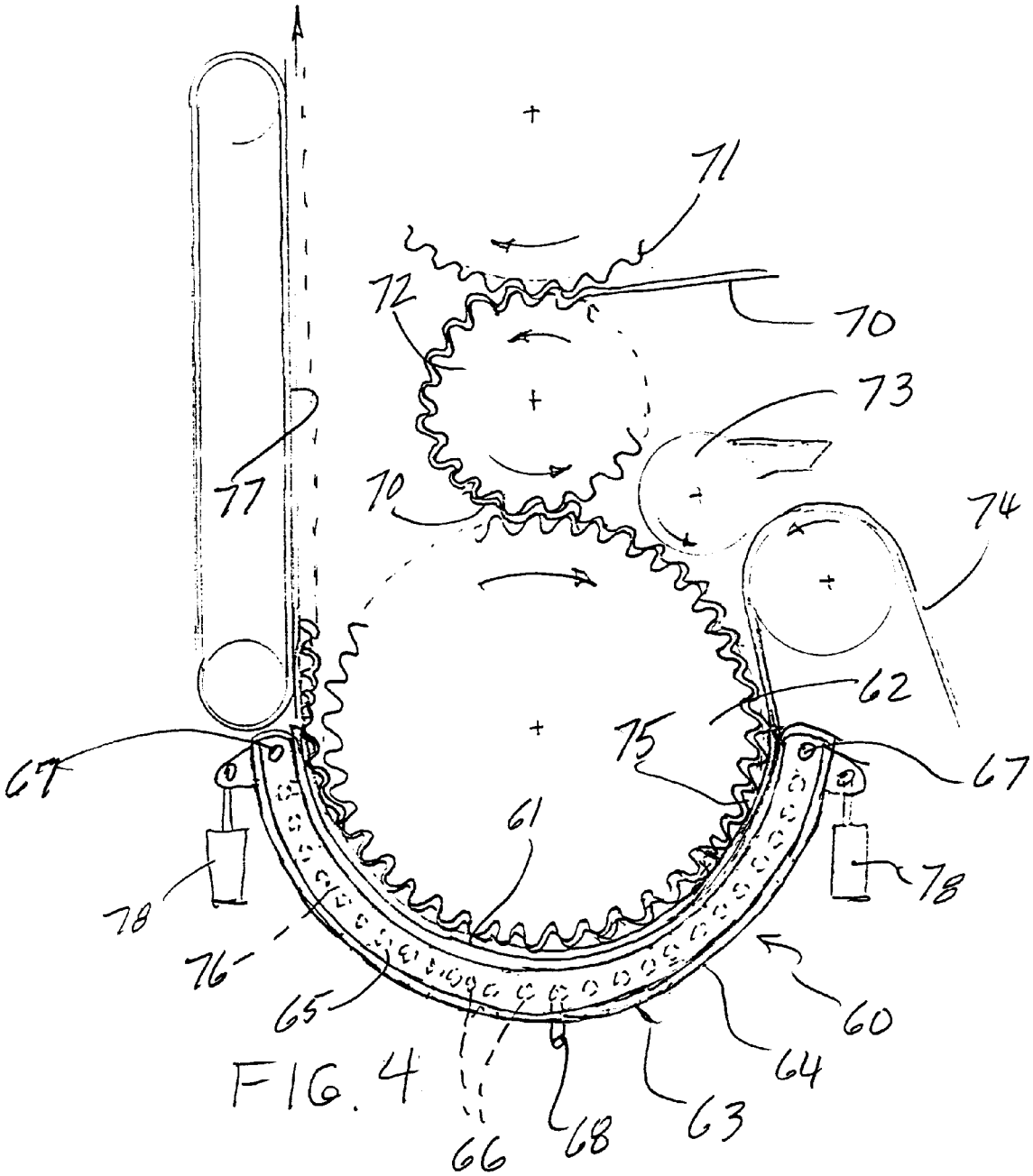
FIG. 4 is a generally schematic side elevation view of an alternate embodiment of a single facer of the present invention.

Another embodiment of a low pressure single facer in accordance with the present invention is shown in FIG. 4. In this embodiment, the steam chamber 42 of the previously described embodiment is replaced with a heating module 60 which includes a flexible heat transfer surface that may be made to conform to the glued single face web on the bonding roll to transmit heat thereto with a very low pressure contact. The heating module 60, for example, may be similar to a heating module disclosed in my copending U.S. patent application Ser. No. 08/697,768, entitled "Improved Heating Module for Upper Web Surface in a Double Backer", filed Aug. 29, 1996. The module 60 has a generally arcuate shape and includes an enclosing inner wall 61 made of a thin flexible sheet material, such as 0.018 inch (0.46 mm) stainless steel sheet. The thin metal sheet 61 is formed into a semicircular shape conforming generally to the outside diameter of the single facer bonding roll 62. The flexible inner wall 61 comprises the radial inner wall of a heating module chamber 63. The chamber includes an outer wall 64 which is rigid enough to maintain the semicylindrical shape of the chamber 63, and a pair of enclosing lateral side walls 65. The chamber 63 is heated by a serpentine arrangement of steam heating tubes which may be conveniently supplied with steam from a pair of inlets 67, each of which is in communication with one of the endmost tubes 66 at the opposite upper ends of the module. A lower central condensate outlet 68 is connected to a central tube at the bottom of the module.

In a manner generally similar to the previously described embodiments, the medium web is corrugated by passage through the nip defined by an upper corrugating roll 71 and an intermediate corrugating roll 72. The corrugated web 70 passes onto the bonding roll 62 where a suitable adhesive is applied to the exposed flute tips with an adhesive applicator 73. A liner web 74 is brought into tangent contact with the flute tips of the corrugated medium 70 on the bonding roll 62 just upstream of one end of the heating module 60.

To provide a low pressure heat transfer from the heating module 60 to the glued single face web 76 on the bonding roll, the interior of the heating module chamber 63 is filled with a suitable heat transfer fluid 76. The heat transfer fluid may comprise a low density liquid, but a gaseous medium is preferred. Specifically, a gas with a high thermal conductivity, such as hydrogen, is preferred. The very thin flexible inner wall 61 of the heating module, backed by the fluid-filled chamber interior, conforms very closely to the outer surface of the liner web 74 of the single face material 75 on the bonding roll 62. This intimate low pressure contact provides good heat transfer to the web to cure the adhesive without the application of substantial pressure. This eliminates the problem of noise and web damage typical of conventional single facers, and allows the single face web to move through the heating and curing zone provided by the module 60 without undue frictional drag. A downstream vacuum drive belt 77 may be utilized to assist in pulling the web through the curing zone on the bonding roll 62. Opposite ends of the heating module 60 may be provided with suitable actuators 78 to move the module by a small amount to accommodate web thread-up and to move the flexible inner wall 61 into and out of heat transfer contact with the single face web.

Figure 5:
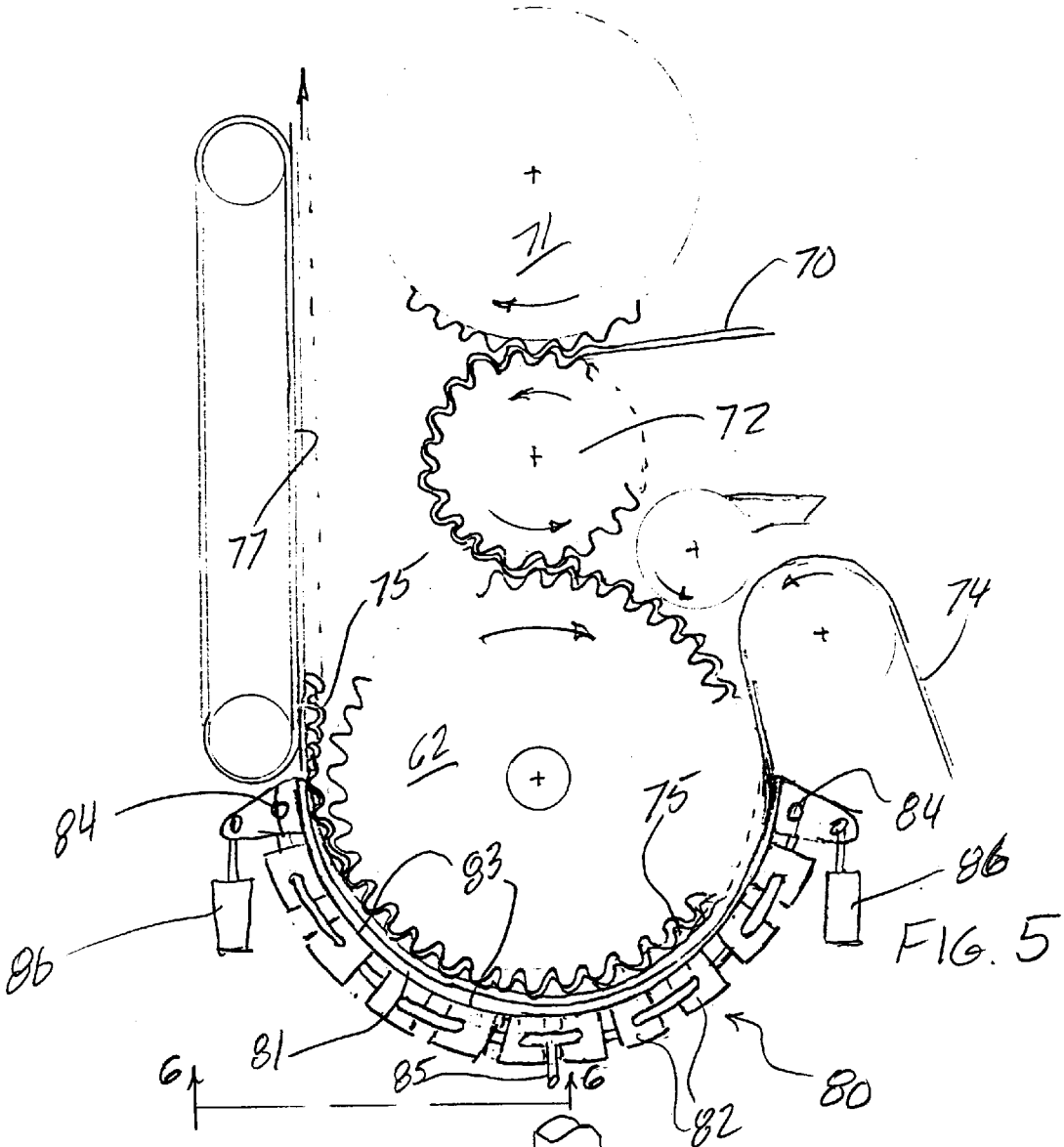
FIG. 5 is a generally schematic side elevation of a further embodiment of a single facer of the present invention.
Figure 6:
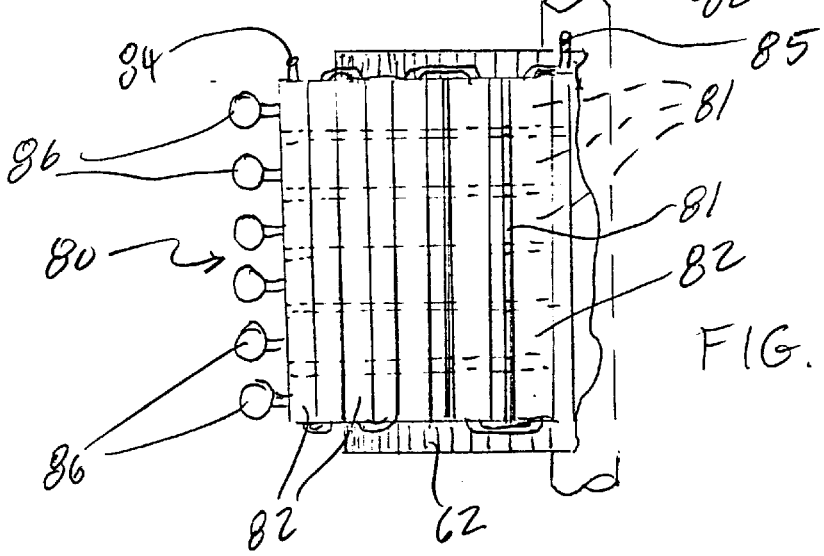
FIG. 6 is a partial bottom plan view taken on line 6—6 of FIG. 5.

Referring now to FIGS. 5 and 6, another embodiment of the invention is shown which includes a heating module 80 that operates in a manner similar to the FIG. 4 embodiment. In this embodiment, the flexible heat transfer surface which conforms to the single face web being carried on the bonding roll 62, comprises a series of parallel flexible bands 81. The bands 81 extend along a portion of the cylindrical outer surface of the bonding roll 62 on which the single face web 75 is being carried. The bands 81 may comprise stainless steel strips, having thickness of 0.018 inch (0.46 mm) and a width, for example, of 3 to 4 inches (7.6 to 10.2 cm). Flexible bands 81 are positioned in parallel spaced relation across the whole width of the unit and are preferably closely spaced about ⅛ inch or 3 mm apart.

To maintain intimate low pressure contact between the flexible bands and the single face web and to provide the transfer of heat thereto for curing, the bands 81 have secured to their outer faces a series of heating tubes 82 which extend in parallel spaced relation across the outer surfaces thereof, in a direction transverse to the direction of movement of the single face web on the bonding roll 62. The heating tubes 82 are interconnected to form a serpentine path for a suitable heating fluid, such as steam, in a manner generally similar to the previously described embodiment. However, each of the heating tubes is attached directly to the outer surface of the flexible metal bands 81, as by soldering, to provide a direct heat transfer thereto. The heating tubes are provided with radial inner surfaces 83 which are machined or otherwise formed to a radius which will cause the flexible bands 81 to conform intimately to the cylindrical surface of the single face web 75 on the bonding roll 62. Specifically, the formed radius of the inner surfaces 83 of the heating tubes is equal to the radius defined by the outer surfaces of the bands 81 when the bands are positioned to intimately contact the cylindrical outer surface of the single face liner web 74 on the bonding roll.

Steam or other suitable heating fluid is supplied to the heating module 80 in the same manner as with the heating module 60 of the FIG. 4 embodiment. Thus, steam may be provided via inlets 84 communicating with the upstream-most and downstream-most heating tubes 82. A condensate outlet 85 is provided in the center or lowermost heating tube 82.

Each of the flexible bands 81 is provided with a pair of loading cylinders 86 operatively connected to the opposite ends of the band. In this manner, the laterally spaced parallel bands 81 may be individually adjusted to provide a heat transfer contact surface which corresponds directly to the width of the single face web 75 being made. The loading cylinders 86 need only move the ends of a flexible band 81 by a very small amount to move the band out of intimate contact with the web on the bonding roll. As soon as intimate contact between a heated band 81 and the web is lost, the band will become hotter and will expand to further remove the band from heat transfer contact. The remainder of the single facer of the embodiment of FIGS. 5 and 6 may include elements which are identical to those described with respect to the FIG. 4 embodiment, and are similarly numbered. If desired, other sources of heat could be substituted for the steam system of this embodiment. For example, the flexible bands could be provided with electrical heat members, hot air or radiant heat systems, or other heating methods known to the art.

Figure 7:
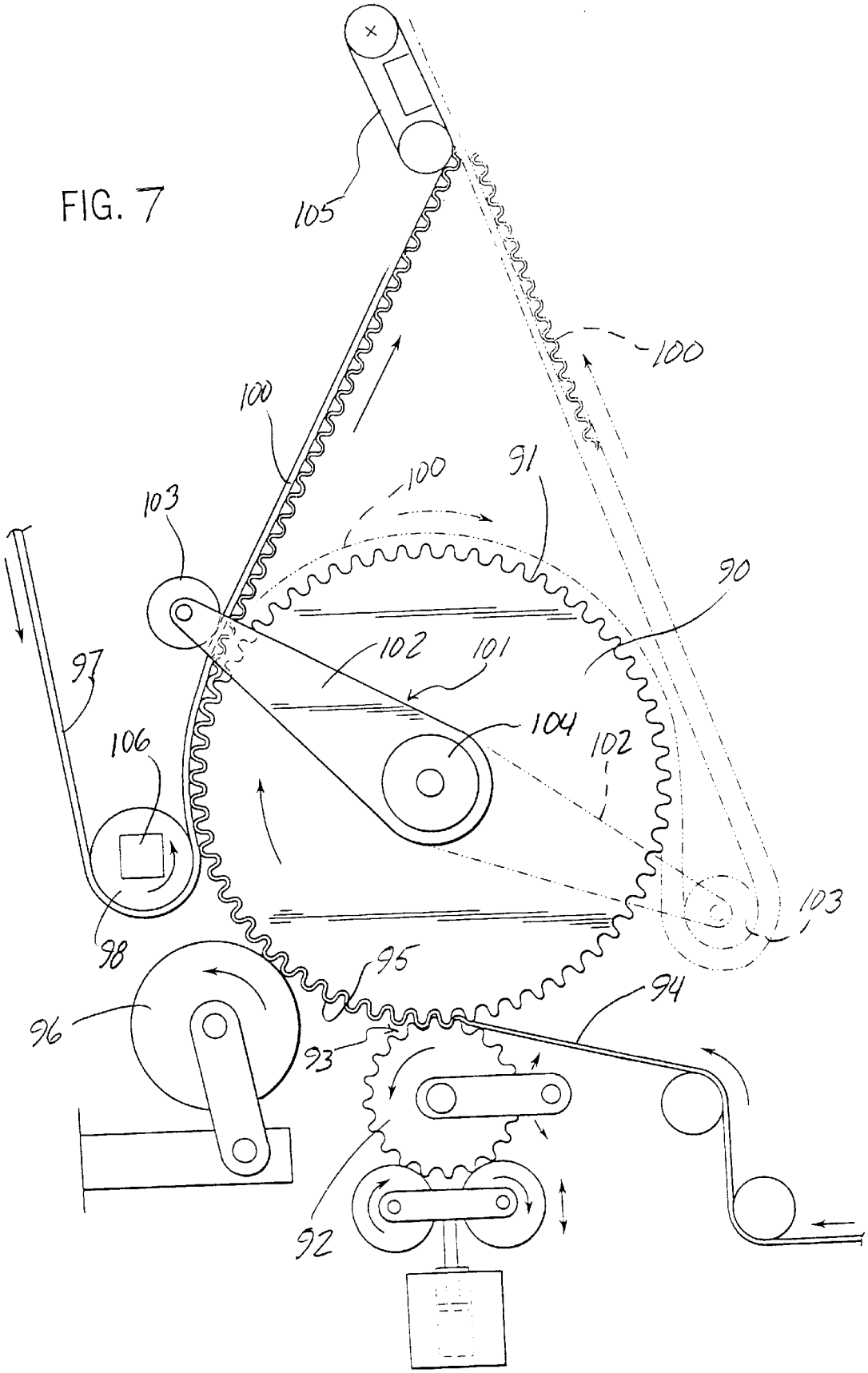
FIG. 7 is a schematic side elevation view of a further and presently preferred embodiment of a single facer of the present invention.

In the FIG. 7 embodiment, a large diameter bonding roll 90 may be constructed in a manner similar to bonding rolls 17 and 26 of the previously described embodiments. Thus, bonding roll 90 is internally heated to provide a temperature at the fluted outer surface 91 sufficient to facilitate formation of a green bond. Unlike the previously described embodiments, however, bonding roll 90 acts directly with a small diameter corrugating roll 92 to form a corrugating nip 93 into which the medium web 94 is directly fed.

Instead of capturing the small corrugating roll 92 between two larger fluted rolls (one of which is the bonding roll), the small corrugating roll 92 is provided with a backing device which provides the nipping force and prevents deflection of the roll 92 utilizing a system disclosed in my copending application entitled "Improved Single Facer with Small Intermediate Corrugating Roll", Ser. No. 08/854,953, filed May 13, 1997. Furthermore, the FIG. 7 apparatus eliminates completely a conventional pressure roll of the type typical of prior art single facers in which two relatively large diameter corrugating rolls are aligned with a pressure roll such that the axes of all three rolls lie generally coplanar. Elimination of the conventional pressure roll, in this embodiment as well as in previously described embodiments, provides a much larger circumferential portion on the bonding roll 90 on which to retain the freshly glued single face web for curing. Further, the embodiment of FIG. 7, in particular, eliminates completely the large upper corrugating roll.

The corrugated medium web 95, exiting the corrugating nip 93, remains on the fluted surface 91 of the bonding roll where the exposed flute tips are immediately coated with lines of adhesive by a glue roll 96 in a manner similar to embodiments previously described. Just downstream of the glue roll 96, a liner web 97 is brought into contact with the glued medium web 95 on a liner delivery roll 98 around which the liner 97 is wrapped and brought generally into tangential contact with the glued flute tips. As in the previously described embodiments, the liner roll 98 is preferably spaced from the fluted outer surface 91 of the bonding roll 90 by a distance sufficient to preclude any significant nip pressure.

The freshly glued single face web 100 is maintained in contact with the heated bonding roll 90 with a wrap arm device 101 which allows the single face to be adjustably wrapped around a circumferential portion of the bonding roll of a selected length or arc. The wrap arm device 100 includes a pair of radially extending wrap arms 102 rotatably mounted on the axis of rotation of the bonding roll 90, but adapted to rotate independently thereof. An idler roll 103 is mounted between the radially outer ends of the wrap arms 102, extends the full length of the bonding roll 90 and is positioned to maintain the single face web 100 in engagement with the fluted outer surface 91 of the bonding roll. A wrap arm drive and locating device 104 is utilized to move the idler roll 103 around the outer surface of the bonding roll 90 to selectively adjust the amount of circumferential wrap of the single face web on the bonding roll. As indicated previously, the use of a small diameter corrugating roll 92, as well as a more compact location of the glue roll 96 and the liner delivery roll 98 to position them closer to the small corrugating roll, will provide for as much as about 270° of wrap of the single face web around the bonding roll. From the idler roll 103 on the wrap arm, the single face web is delivered to a downstream web drive 105 from which it is carried to further downstream processing or storage, such as a conventional bridge storage area.

Pressure on the glued flute tips as the single face web is carried around the bonding roll 90 is provided directly as a result of the radially inward force generated by liner web tension. Web tension and, therefore, the radial pressure generated on the glued flute tips may be readily varied. For example, the web drive 105 could be operated at a slight overspeed with respect to the speed of the web on the bonding roll 90. Preferably, however, web tension is varied by retarding the liner web delivery roll 98 with the use of a suitable adjustable breaking device 106. Thus, tension in the liner wrapped on the bonding roll replaces a conventional pressure roll in the single facer. Furthermore, a substantial portion of the circumference of the heated bonding roll may be utilized to assure an adequate green bond has formed before the single face web is removed from the bonding roll.

I claim:

1. An apparatus for forming a single face corrugated paperboard web from a liner web and a corrugated medium web by corrugating, gluing, joining and bonding the component webs on a common roll, said apparatus comprising:

a large diameter rotary fluted bonding roll forming a corrugating nip with a small diameter fluted corrugating roll, said large diameter bonding roll carrying the corrugated medium web from the nip;

means for applying a starch adhesive to the exposed flute tips of said corrugated medium web on the bonding roll;

means for joining the liner web with the medium web on the bonding roll without nipping pressure to create uncured adhesive glue lines between the liner and said exposed flute tips;

means for heating said bonding roll to heat the web to a bonding temperature of at least 200° F.;

means for adjustably wrapping the glued single face web around more than half of the circumference of the bonding roll surface downstream of the point of joining the liner web with the medium web sufficient to permit substantially complete formation of green bonds in said adhesive glue lines; and, said wrapping means being operative to limit radial pressure applied to the web to that induced by web tension.

2. The apparatus as set forth in claim 1 comprising:

a small diameter fluted corrugating roll having a diameter not greater than about one-third the diameter of the bonding roll.

3. The apparatus as set forth in claim 1 wherein said adjustable wrapping means comprises:

a wrap arm mounted for rotation on the axis of the bonding roll;

an idler roll carried by the wrap arm and positioned adjacent the glued single face web on the bonding roll and with the axis of said idler roll parallel to the bonding roll axis; and, means for rotation said wrap arm on the axis of said bonding roll to wrap a selected length of the glued single face web on said bonding roll surface.

4. The apparatus as set forth in claim 3 wherein said wrap arm is operable on an arc of up to about 270°.

5. The apparatus as set forth in claim 3 including web drive means downstream of said wrap arm idler roll for carrying said single face web to a downstream processing station.

6. The apparatus as set forth in claim 1 wherein said joining means comprises a rotatable liner roll carrying the liner web thereon and forming with the bonding roll a no pressure nip for said liner web and the glued medium web.

7. The apparatus as set forth in claim 6 including a braking device for retarding rotation of said liner roll and increasing the tension in the liner web wrapped on the bonding roll.

8. A method for corrugating, gluing, joining and forming on a common roll substantially complete adhesive green bonds in a single face corrugated paperboard web which includes a liner web adhesively joined to the glued flute tips of a corrugated medium web, the method comprising the steps of:

(1) providing a large diameter heated fluted rotary bonding roll;

(2) feeding a medium web into a corrugating nip formed by rotatably engaging the bonding roll with a fluted corrugating roll having a diameter not greater than about one-third the diameter of said bonding roll;

(3) applying a starch adhesive to the exposed flute tips of the corrugated medium web on the bonding roll as the medium web exits the corrugating nip;

(4) joining in the absence of nipping pressure the liner web to the glued flute tips of the corrugated medium web on the bonding roll;

(5) causing said feeding, applying and joining steps to occur along less than half of the circumference of the bonding roll extending from the nip;

(6) heating the bonding roll to a temperature sufficient to heat the web on the bonding roll to at least 200° F.;

(7) wrapping the single face web around the bonding roll downstream from joining of the liner along a circumferential portion of the bonding roll adjustably selected to provide formation of the green bond; and, (8) limiting the radial pressure applied to the web during the wrapping step to that induced by web tension.

9. The method as set forth in claim 8 wherein said circumferential portion is adjustable to a maximum arc of about 270°.

* * * * *